United States Patent [19]

Feldkämper

[11] 4,202,229

[45] May 13, 1980

[54] APPARATUS FOR TRANSVERSELY SEVERING OR TRANSVERSELY PERFORATING WEBS OF MATERIAL

[75] Inventor: Richard Feldkämper, Lengerich, Fed. Rep. of Germany

[73] Assignee: Windmoller & Holscher, Lengerich, Fed. Rep. of Germany

[21] Appl. No.: 948,498

[22] Filed: Oct. 4, 1978

[30] Foreign Application Priority Data

Oct. 31, 1977 [DE] Fed. Rep. of Germany ..... 2748826

[51] Int. Cl.[2] ..... B26F 1/08; B31B 1/14; B26D 7/00

[52] U.S. Cl. ..... 83/304; 83/311; 83/327; 83/331

[58] Field of Search ..... 83/304, 305, 311, 327, 83/328, 331, 345

[56] References Cited

FOREIGN PATENT DOCUMENTS 906536 3/1954 Fed. Rep. of Germany .
1229374 6/1967 Fed. Rep. of Germany .
1231099 7/1967 Fed. Rep. of Germany .

*Primary Examiner*—J. M. Meister
*Attorney, Agent, or Firm*—Fleit & Jacobson

[57] ABSTRACT

Cutting or perforating apparatus for a web of material enabling at least one knife on at least one rotary knife shaft to cut the web at adjustable intervals comprises mounting plates for the knife shaft that are fixed on a rotatable plate shaft. The knife shaft is driven by a central gear freely rotatable on the plate shaft. An operative connection between the plate shaft and control gear comprises a first gear fixed to the plate shaft and engaging a second gear rotatable on a fixed pin, a third gear rotatable on said pin and engaging a fourth gear fixed to said central gear. Said second and third gears are coupled by a mechanism comprising a first gear segment connected to said third gear and engaging a second gear segment secured to a freely rotatable pin eccentrically positioned on said second gear, said rotatable pin also carrying a slotted link slidable on a fixed projection. The radial spacing of said projection from said fixed pin is half the eccentricity of said rotatable pin and equal to the radii of the pitch circles of said gear segments.

5 Claims, 10 Drawing Figures

Fig. 1
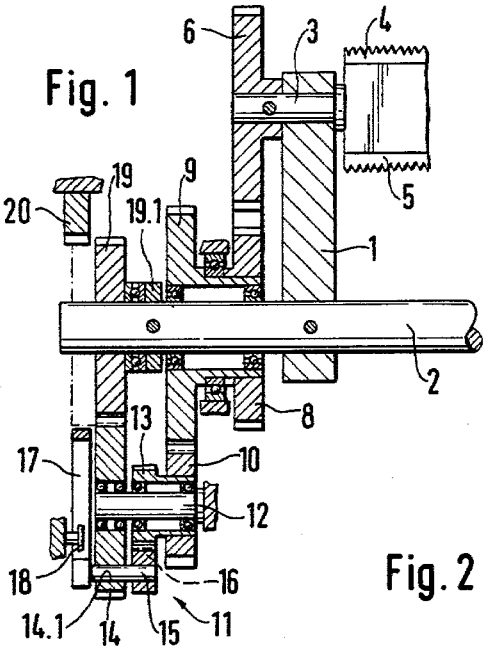
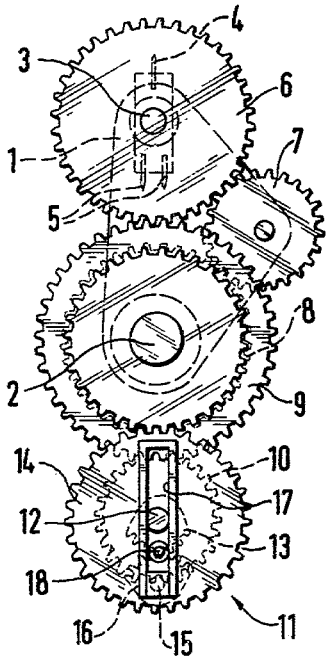
Fig. 2
Fig. 3
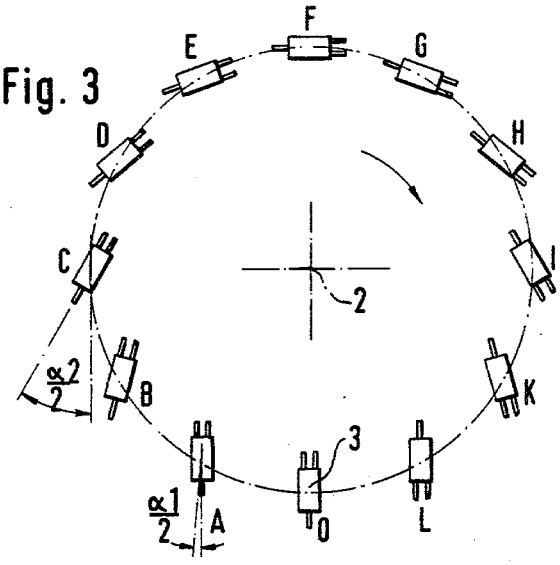

APPARATUS FOR TRANSVERSELY SEVERING OR TRANSVERSELY PERFORATING WEBS OF MATERIAL

The invention relates to an apparatus for transversely severing or transversely perforating webs of material, preferably paper webs in the production of paper sacks, comprising a grooved shaft mounted in the frame of the apparatus and at least one knife shaft which carries at least one knife, is rotatably mounted in revolving end plates eccentrically to the shaft thereof and is driven by way of a spur gear on the knife shaft from an intermediate gear freely rotatable in one of the end plates and a central gear which meshes with the intermediate gear, is coaxial with the end plates and is freely rotatable relatively thereto.

In an apparatus of this kind known from DT-PS No. 906 536, the central gear is coupled to the end plate shaft by means of a switching mechanism which can be made inoperative and replaced so that different manners of operation are possible. If the central gear is held fixed with respect to the frame, the parallel gearing consisting of the intermediate gear and the central gear ensures that the cutting knives on the knife shaft are moved along parallel to themselves during rotation of the end plates.

If the central gear which is loosely rotatably mounted on the end plate shaft is coupled to the switching mechanism consisting of a double gear and a gear segment which engages a gear and is secured to the end plate shaft, then the knife shaft is turned along a portion of its circular track so that a plurality of knives or tools secured thereon can be successively brought into position to act on the paper web. In the known apparatus, the disadvantage is not only the shock-like engagement of the switching mechanism that leads to high stressing of the gearing and thus extensive wear as well as thumping noises but it is also not seen how one can achieve an accurately defined change-over of the knife shaft and subsequent retention of the central gear.

In an apparatus of the aforementioned kind known from DT-AS No. 1 229 374, the central gear forms the sun gear of planetary gearing by way of which it is coupled to the central end plate shaft. To set the apparatus for cutting various figures, it is necessary to replace two interengaging gears of the planetary gearing which are disposed to be readily accessible from the outside. To achieve different knife positions and also turning of the knife shaft as the end plates revolve, the exchangeable pair of gears of the planetary gearing can be a pair of elliptical eccentric gears. The known apparatus is not only cumbersome to convert to different manners of operation by replacement of a pair of interengaging gears but the production of pairs of elliptical eccentric gears is also very expensive.

In a similar cutting appparatus known from DT-AS No. 1 231 099, the planetary gearing consists of a pair of elliptical eccentric gears of which the central gear is stationary. In this case, to replace the pair of elliptical eccentric gears so as to cut different figures, it is necessary to reconstruct the entire gearing.

It is the problem of the present invention to provide a cutting apparatus of the aforementioned kind that can be easily and rapidly converted to different manners of operation and operates with little noise.

According to the invention, this problem is solved in that a gear secured to the end plate shaft engages a spur gear mounted on a pin fixed with respect to the frame or a shaft mounted in the frame, a further spur gear which is mounted or secured on the pin or shaft, respectively, meshing with a gear connected to the central gear by a tubular strut to form a gear set, that the gears mounted on the pin or secured on the shaft are coupled by variable speed gearing comprising a gear segment which is connected to the gear meshing with the gear set and which engages a countersegment secured to a freely rotatably pin eccentrically mounted on the other spur gear, the other end of the pin carrying a slotted guide sliding on a slide block fixed with respect to the frame, that the slide block is disposed at a radial spacing from the centreline of the fixed pin or shaft corresponding to half the eccentricity of the pin mounted on the spur gear, that the radius of the pitch circles of the gear segments is likewise half said eccentricity, and that the knife projects into a cutting groove when the point of contact of the pitch circles of the gear segments passes through the centreline of the slide block. In the apparatus according to the invention, the output gear of the variable speed gearing is at a standstill during cutting so that the central gear is held and the cutting knife projects parallel to itself into the cutting groove on the grooved shaft. Since the knife shaft or knife shafts are turned during the remainder of rotation of the input spur gear of the variable speed gearing, an appropriate selection of the transmission ratio enables different cutting knives on the or each knife shaft to be brought to their cutting positions in a desired sequence.

If the input spur gear of the variable speed gearing is driven faster than the end plates in which the knife shafts are mounted, more than one cutting position can be achieved per revolution of the end plate in which the cutting knives move parallel to themselves into the associated cutting groove. If the transmission ratio between the output gear of the variable speed gearing and the central gear is changed, a plurality of cutting knives on one knife shaft can be brought to the cutting position in succession. Finally, it is also possible to uncouple the input gear of the variable speed gearing from the end plate shaft and to hold them fixed with respect to the frame so that the cutting knives are constantly guided parallel to themselves.

In one form of the invention, two knives displaced by 180° are provided on the knife shaft and the transmission ratio between the gear forming the output gear of the variable speed gearing and the gear set containing the central gear is 1:2. By means of the spur gear coupled to the end plate shaft, the variable speed gearing is set into rotation so that the output gear of the variable speed gearing comes to a standstill once per revolution and the knives are guided in parallel during cutting and cut alternately. If the webs are to be cut into over-size lengths, one of the knives can be dismantled so that the webs are transversely cut only during every second revolution of the knife shaft.

The gear secured to the end plate shaft can be releasable therefrom so that it is freely rotatable thereon and, whilst maintaining engagement with the gear which forms the input of the variable speed gearing and is mounted on the pin fixed with respect to the frame or secured on the shaft mounted in the frame, it is lockable to a gear segment fixed with respect to the frame. If the gear is in this way displaced to its blocked position, the central gear is held and the knives are guided parallel to themselves. If, for example, there is only one knife shaft equipped with two knives, during each revolution of the end plates always the same knife will be brought to the cutting position.

In a further embodiment of the invention, it is provided that a plurality of knife shafts driven by the central gear are mounted at uniform angular spacings in the end plates and the transmission ratio between the gear secured to the end plate shaft and the gear forming the input of the variable speed gearing is variable by interposed gear stages with at least one replaceable spur gear so that the knives secured to the knife shafts cut in a freely selectable sequence.

Examples of the invention will now be described in more detail with reference to the drawing, wherein:

FIG. 1 is a diagrammatic axial section through a cutting apparatus in which the grooved shaft has been omitted;

FIG. 2 is an elevation in the axial direction of the FIG. 1 apparatus;

FIG. 3 illustrates the different knife positions during one revolution of the end plates;

Figure 4:
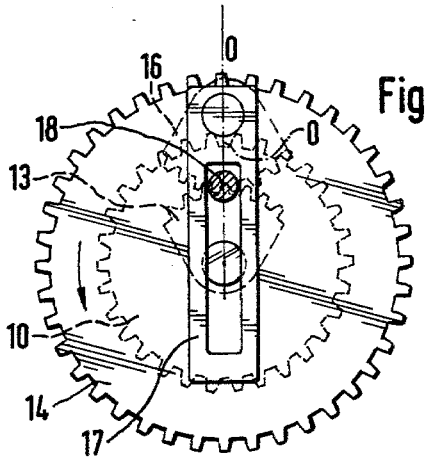
FIGS. 4 to 7 show the positions of the variable speed gearing corresponding to the FIG. 3 positions.
Figure 5:
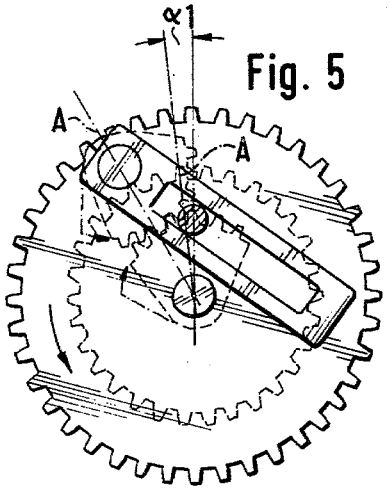
Figure 6:
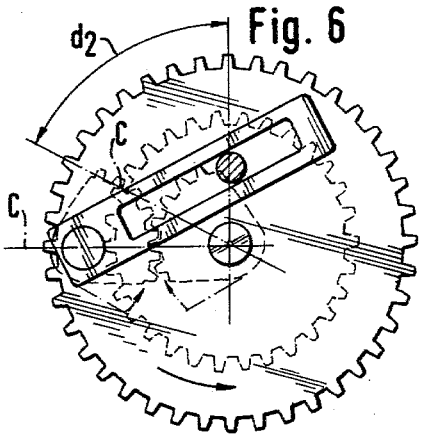
Figure 7:
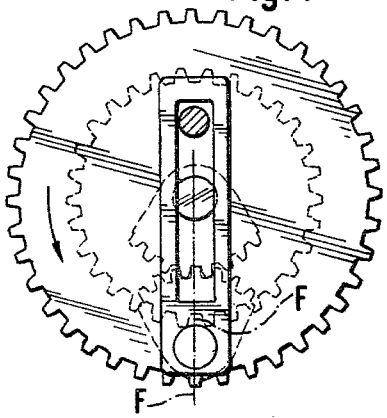

Two end plates 1 are secured on a shaft 2, only one of the end plates being shown in the drawing. Cutting knives 4, 5 are secured on a knife shaft 3 which is rotatably mounted in the end plates 1. The cutting knife 4 serves to make a smooth cut and the cutting knives 5 can execute an economy cut. On the end of the knife shaft 3 projecting to the left beyond the one end plate 1, a spur gear 6 is secured which meshes with an intermediate gear 7 loosely rotatably mounted on the end plate 1. A gear set consisting of the spur gears 8, 9 is loosely rotatable on the shaft 2 and is also mounted for rotation in the frame of the machine. The spur gear 8 meshes with the intermediate gear 7 and the spur gear 9 with a spur gear 10 which is part of variable speed gearing 11 and is loosely rotatably mounted on a pin 12 fixed with respect to the frame. The pitch circle of the spur gear 10 is only half the size of the pitch circle of the spur gear 9.

A gear segment 13 is fixed to the spur gear 10. A spur gear 14 which is also loosely rotatably mounted on the pin 12 has an eccentric bore 14.1 in which a pin 15 is rotatably mounted. A gear segment 16 engaging the gear segment 13 is secured to the pin 15 on the side adjacent the segment 13. On the other side a slotted guide 17 is secured to the pin 15, in which a fixed slide block 18 in the form of a rotational solid is readily displaceable, the axis of the slide block being parallel to the pin 12 and at a spacing from the axis thereof equal to the pitch circle radius of the gear segment 13.

The variable speed gearing 11 thus consists of the members 12 to 18 and 10.

A spur gear 19 is freely rotatable and axially displaceable on the shaft 2. Next to it, a gear segment 20 is fixed with respect to the frame. The gear 19 can be axially displaced so that it engages the gear segment 20 but still remains in engagement with the spur gear 14. In this position, the variable speed gearing 11 is blocked so that the gear set consisting of the spur gears 8, 9 is also at a standstill and the gears 6 to 8 operate as parallel gears. In the blocked position of the spur gear 19, only one of the cutting knives 4 or 5 will act on the paper web during each revolution of the shaft.

In the driving position of the spur gear 19 shown in FIG. 1, where it engages in a coupling member 19.1 fixed to the shaft 2, the variable speed gearing 11 rotates. When the line of contact of the pitch circles of the two gear segments 13, 16 passes through the axis of the slide block 18, the spur gear 10 comes to a standstill so that the cutting knives 4 to 5 will at this instant not pivot about the axis of the shaft 3 and will project into the cutting groove of the grooved shaft (not shown) whilst being guided parallel to themselves. By reason of the aforementioned transmission ratio of the spur gears 9 and 10 of 2:1, the cutting knife 4 and the cutting knife 5 engage alternately during rotation of the shaft 2 when the spur gear 19 is in the driving position, so that a smooth cut is made alternately with an economy cut during the next revolution.

After the cutting knives 5 have been dismantled, one knife, namely the knife 4, can act on the paper web only during each second revolution, in which case over-size lengths can be cut.

FIG. 3 illustrates the individual knife positions A to L during one revolution of the end plates 1. During the following revolution, the knives assume a position turned through 180°.

FIGS. 4 to 7 illustrate the positions of the variable speed gearing corresponding to the knife positions O, A, C and F. In the position shown in FIG. 4, the point of contact of the pitch circles of the gear segments 13, 16 passes through the centreline of the slide block 18 so that a stationary pole is formed and the spur gear 10 stands still. This position corresponds to the knife position O in which the outwardly directed knife projects into the cutting groove (not shown).

Figure 8:
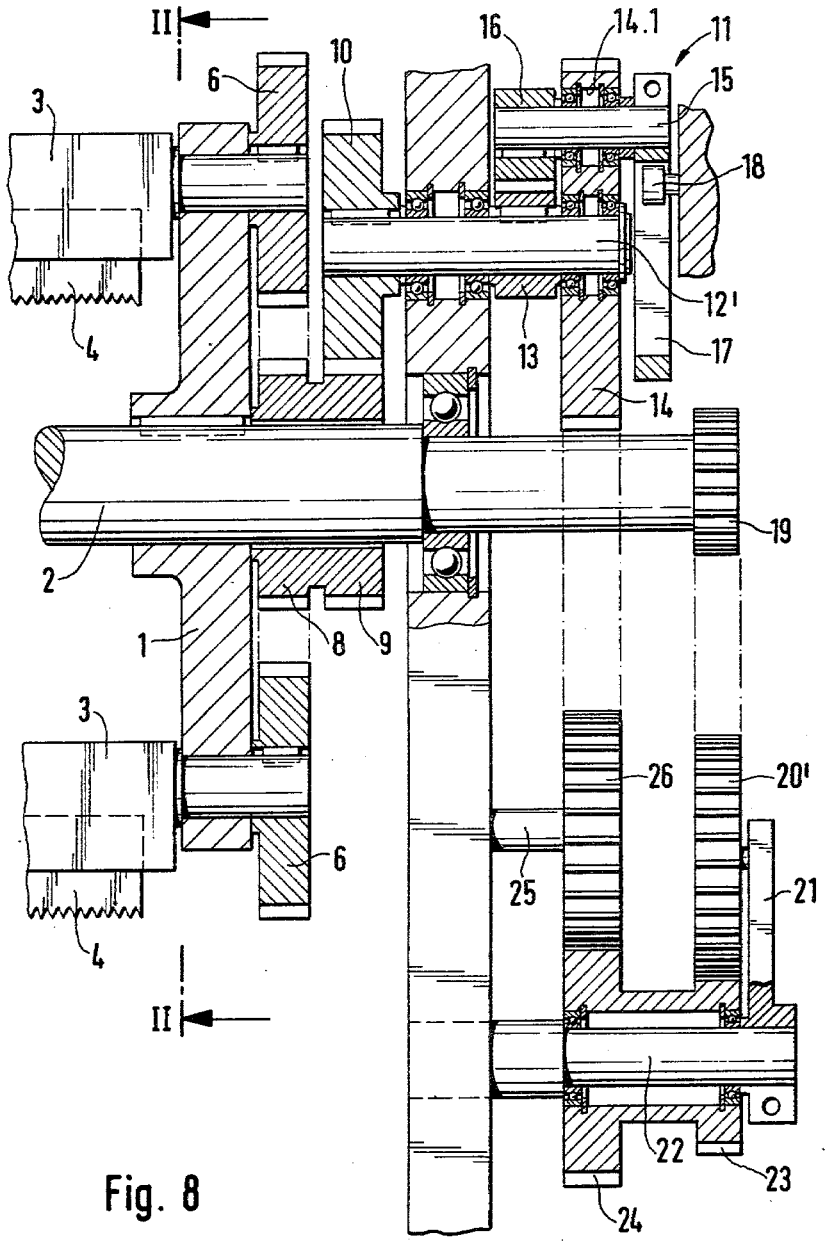
FIG. 8 is an axial section through a different embodiment of a cutting apparatus in which the grooved shaft has likewise been omitted.
Figure 9:
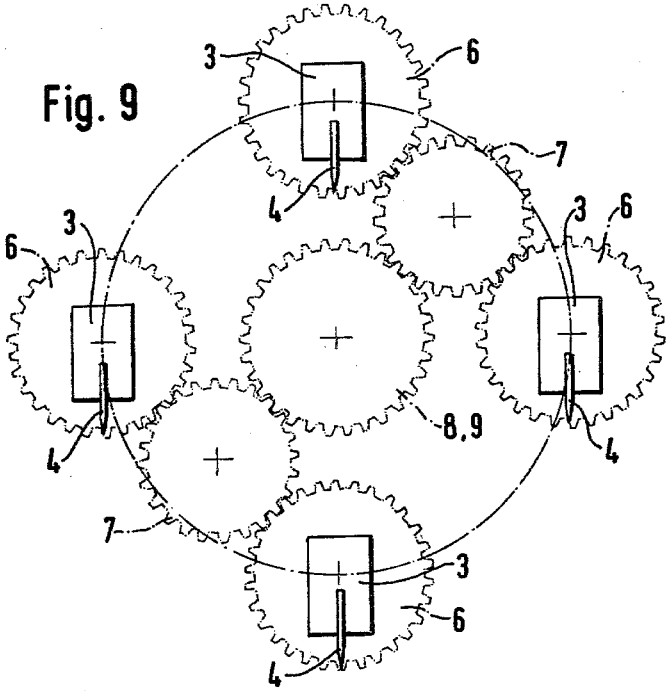
FIG. 9 is a section on the line II—II in FIG. 1.
Figure 10:
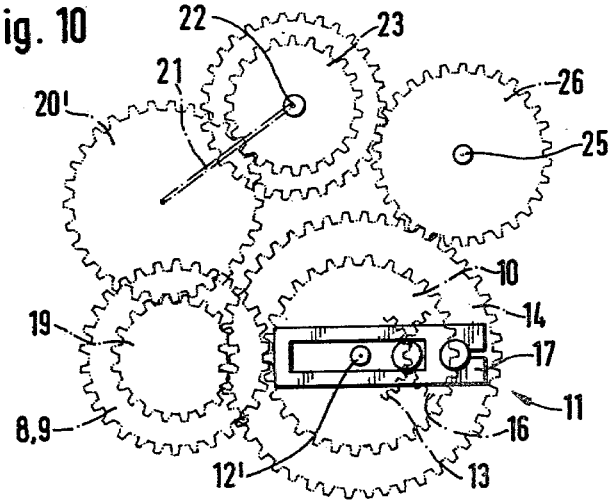
FIG. 10 is a diagrammatic end elevation of the gearing driving the central gear of FIG. 8.

FIGS. 8 to 10 illustrate an embodiment in which the end plates 1 support four knife shafts, each carrying one cutting knife, at equal angular spacings. The components corresponding to the example of FIGS. 1 to 8 are provided with the same reference numerals.

Two end plates 1, of which only one is shown in the drawing, are secured on a shaft 2. Cutting knives 4 are secured to four knife shafts 3 which are rotatably mounted in the end plates 1. Spur gears 6 secured to the ends of the knife shafts 3 projecting beyond the one end plate 1 mesh with intermediate gears 7 which are loosely rotatable on the end plate 1. A gear set consisting of the spur gears 8, 9 is loosely rotatable on the shaft 2. The spur gear 8 meshes with the intermediate gears 7 and the spur gear 9 with a spur gear 10 which is part of variable speed gearing 11 and is secured to a shaft 12' which is rotatable in the frame of the machine. The pitch circles of the spur gears 9 and 10 are equal. Also loosely rotatable on the shaft 12' there is a spur gear 14 which has an eccentric bore 14.1 in which a pin 15 is rotatably mounted. On the side of the gear segment 13, a gear segment 16 is secured to the pin 15 and meshes with the gear segment 13. On the other side, the pin 15 is secured to a slotted guide 17 in which a fixed slide block 18 in the form of a rotational solid is easily displaceable. The axis of the block 18 is parallel to the axis of the pin 12 and at a spacing therefrom equal to the pitch circle radius of the gear segment 13.

A replaceable spur gear 19 is mounted on the shaft 2 for rotation therewith. It engages a spur gear 20 which is freely rotatable on a lever 21. The lever 21 is easily replaceably keyed to a fixed pin 22 so that the spur gear 20' can be swung away from the spur gear 19. A gear set freely rotatable on the pin 22 has one spur gear 23 in mesh with the spur gear 20' and the other spur gear 24 in mesh with an intermediate gear 26 which is freely rotatable on a fixed pin 25 and co-operates with the spur gear 14. By replacing the spur gear 19 for one having a different pitch circle diameter, the transmission ratio between the spur gears 14 and 19 and thus the lengths of tube sections severed by means of the transverse cutting apparatus can be altered.

When the spur gears 14 and 19 have the same pitch circle diameter, the spur gear 14 turns at the same speed as the end plates 1. Each time the line of contact of the pitch circles of the two gear segments 13 and 16 passes through the axis of the slide block 18, the spur gear 10 comes to a standstill and one of the four cutting knives 4 at this instant does not pivot about the axis of the shaft 3 and projects parallel to itself into the cutting groove of the grooved shaft (not shown). After a quarter turn of the end plates 1, i.e. when it would be the turn of the next cutting knife 4 to cut, the spur gear 14 has likewise executed one quarter of one turn, whereby the cutting knife 4 fails to project into the cutting groove and is swung aside instead. It is only the cutting knife 4 that was first considered which will cut again after one complete revolution. With a transmission ratio of $i=1$, therefore, every fourth cutting knife executes a cut.

If the spur gear 14 is twice as large as the spur gear 19, only every eighth cutting knife is employed, i.e. cutting is effected only after each completed second rotation of the end plates 1. Similarly, each second cutting knife can cut if $i=2$, i.e. the spur gear 19 is twice as large as the spur gear 14. If $i=1.3$, each third cutting knife cuts. If $i=0.8$, each fifth cutting knife cuts. If $i=0.66$, each sixth cutting knife cuts and if $i=0.572$, each seventh cutting knive cuts.

The transmission ratio of $i=1$ can also be achieved by dispensing with equal pitch circle diameters for the spur gears 14 and 19 and selecting the spur gear 14 to have the same diameter as the gear 24 and the spur gear 19 to have the same diameter as the gear 23. The size of the gears 20' and 26 is not included in the calculation because these gears act as intermediate gears.

If each cutting knife is to cut or, expressed in other words, if four cuts are to be made per revolution of the end plates 1, the spur gear 20 is swung away from the spur gear 19 and prevented from rotating in any suitable manner. In that case the gears 6, 7 and 8 act as parallel gears so that each cutting knife comes into action.

I claim:

1. Apparatus for transversely severing or transversely perforating webs of material, preferably paper webs in the production of paper sacks, comprising a grooved shaft mounted in the frame of the apparatus and at least one knife shaft which carries at least one knife, is rotatably mounted in revolving end plates eccentrically to the shaft thereof and is driven by way of a spur gear on the knife shaft from an intermediate gear freely rotatable in one of the end plates and a central gear which meshes with the intermediate gear, is coaxial with the end plates and is freely rotatable relatively thereto, characterised in that a gear (19) secured to the end plate shaft (2) engages at least one spur gear (14) mounted on a pin (12) fixed with respect to the frame or a shaft (12') mounted in the frame, a further spur gear (10) which is mounted or secured on the pin or shaft, respectively, meshing with a gear (9) connected to the central gear (8) by a tubular strut to form a gear set, that the gears (10, 14) mounted on the pin or secured on the shaft are coupled by variable speed gearing comprising a gear segment (16) which is connected to the gear (10) meshing with the gear set (8, 9) and which engages a counter-segment (13) secured to a freely rotatable pin (15) eccentrically mounted on the other spur gear (14), the other end of the pin (15) carrying a slotted guide (17) sliding on a slide block (18) fixed with respect to the frame, that the slide block (18) is disposed at a radial spacing from its medial plane of the fixed pin or shaft corresponding to half the eccentricity of the pin (15) mounted on the spur gear (14), that the radius of the pitch circles of the gear segments (13, 16) is likewise half said eccentricity, and that the knife (4, 5) projects into a cutting groove when the point of contact of the pitch circles of the gear segments (13, 16) passes through the centreline of the slide block (18).

2. Apparatus according to claim 1, characterised in that two knives displaced by 180° are provided on the knife shaft and the transmission ratio between the gear (10) forming the output gear of the variable speed gearing and the gear set containing the central gear (8) is 1:2.

3. Apparatus according to claim 1 or claim 2, characterised in that the gear (19) is releasable from the end plate shaft (2) such that it is freely rotatable thereon and, whilst maintaining engagement with the gear (14) mounted on the pin (12) fixed with respect to the frame or secured on the shaft (12') mounted in the frame, it is lockable to a gear segment (20) fixed with respect to the frame.

4. Apparatus according to claim 1, characterised in that a plurality of knife shafts (3) driven by the central gear (8) are mounted at uniform angular spacings in the end plates and the transmission ratio between the gear (19) secured to the end plate shaft and the gear (14) forming the input of the variable speed gearing is variable by interposed gear stages with at least one replaceable spur gear (19) so that the knives secured to the knife shafts project into the associated cutting grooves in a freely selectable sequence.

5. Apparatus according to claim 4, characterised in that the spur gear (14) can be uncoupled from the end plate shaft (2) and locked to the frame.

* * * * *

UNITED STATES PATENT AND TRADEMARK OFFICE

CERTIFICATE OF CORRECTION

PATENT NO. : 4,202,229

DATED : May 13, 1980

INVENTOR(S) : RICHARD FELDKAMPER

It is certified that error appears in the above—identified patent and that said Letters Patent is hereby corrected as shown below:

On the title page, under Foreign Application Priority Date, change the number of the prior German application from "2748826" to -- 2748820 --.

Signed and Sealed this

*Fourth* Day of *November 1980*

[SEAL]

*Attest:*

SIDNEY A. DIAMOND

*Attesting Officer*

*Commissioner of Patents and Trademarks*